US007063517B2

(12) United States Patent
Towne et al.

(10) Patent No.: US 7,063,517 B2
(45) Date of Patent: Jun. 20, 2006

(54) VALVE APPARATUS AND PNEUMATICALLY DRIVEN DIAPHRAGM PUMP INCORPORATING SAME

(75) Inventors: Lloyd I. Towne, Bryan, OH (US); Thomas R. Headley, Bryan, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/869,074

(22) Filed: Jun. 16, 2004

(65) Prior Publication Data

US 2005/0281688 A1 Dec. 22, 2005

(51) Int. Cl.
*F04B 43/06* (2006.01)

(52) U.S. Cl. ..... 417/395; 137/625.66; 251/31

(58) Field of Classification Search ..... 137/625.66; 251/31; 417/393, 395
See application file for complete search history.

(56) References Cited

U.S. PATENT DOCUMENTS

| | | | | | |
|---|---|---|---|---|---|
| 2,860,651 | A | * | 11/1958 | Davies | 251/31 |
| 3,507,097 | A | * | 4/1970 | Crowley et al. | 96/114 |
| 3,623,695 | A | * | 11/1971 | Hislop | 137/625.66 |
| 3,652,187 | A | * | 3/1972 | Loeffler et al. | 417/393 |
| 3,762,443 | A | * | 10/1973 | Sorenson | 137/625.66 |
| 3,773,082 | A | * | 11/1973 | Davis | 251/31 |
| 4,138,089 | A | * | 2/1979 | McCarthy | 251/31 |
| 4,237,931 | A | * | 12/1980 | Rafaely | 137/625.66 |
| 4,303,003 | A | * | 12/1981 | Reip | 91/451 |
| 4,496,294 | A | | 1/1985 | Frikker et al. | |
| 4,549,467 | A | | 10/1985 | Wilden et al. | |
| 4,854,832 | A | | 8/1989 | Gardner et al. | |
| 5,149,589 | A | * | 9/1992 | Naritomi et al. | 428/412 |
| 5,391,060 | A | | 2/1995 | Kozumplik, Jr. et al. | |
| 5,649,813 | A | * | 7/1997 | Able et al. | 417/393 |
| 6,168,394 | B1 | | 1/2001 | Forman et al. | |
| 6,722,256 | B1 | | 4/2004 | Roberts et al. | |
| 6,901,960 | B1 | * | 6/2005 | Roberts et al. | 137/625.66 |
| 2004/0047749 | A1 | | 3/2004 | Oakley et al. | |

FOREIGN PATENT DOCUMENTS

| | | |
|---|---|---|
| GB | 2140097 | 11/1984 |

OTHER PUBLICATIONS

Technical Bulletin, No. 5202B-1 USA, Internet Webpage for Parker Hannifin Corporation, Engineered Polymer Systems Division, Salt Lake City, UT, "Resilon™ HT (P4300) High-Performance Polyurethane", Copyright ® 2001, Parker Hannifin Corporation, Cleveland, OH, 2 Pages.

* cited by examiner

*Primary Examiner*—Michael Koczo, Jr.
(74) *Attorney, Agent, or Firm*—Michael Best & Friedrich LLP

(57) ABSTRACT

A valve apparatus and pneumatically driven diaphragm pump incorporating same having a valve body having a longitudinal axis and an actuator having an axis with a first end and a second end. The first and second ends have first and second diaphragms, respectively, disposed thereon and located transversely to the axis of the actuator. Upon inserting the actuator into the valve body, the first and second diaphragms define wall portions of first and second chambers at the first and second ends of the axis of the actuator, respectively, and a chamber defined between the diaphragms.

7 Claims, 6 Drawing Sheets

VALVE APPARATUS AND PNEUMATICALLY DRIVEN DIAPHRAGM PUMP INCORPORATING SAME

BACKGROUND OF THE INVENTION

This invention relates generally to valves and more particularly to directional control valves for pneumatic applications.

Spool valves are used and known in the art as directional control valves for changing the direction of a motive fluid to and from pistons or diaphragms located within cylinders or other chambers, respectively. A conventional spool valve comprises a valve body and a sliding spool actuator which, upon shifting therein, alternately defines flow passages within the valve body to a supply pressure or an exhaust port causing a cylinder's piston rod or chamber's diaphragm to be moved and work performed.

Typically, such directional control valves have been used as the major distribution valve for providing a pressurized motive fluid, e.g., pressurized air, to chambers associated with a double acting diaphragm pump. Examples are shown in commonly assigned U.S. Pat. Nos. 4,854,832, 5,391,060, and 6,722,256, the disclosures of which are incorporated herein by reference. In U.S. Pat. No. 5,391,060, a spool valve is disposed in a valve body and connects air supply and exhaust ports to appropriate diaphragm air chambers via O-rings located on the spool valve. U.S. Pat. Nos. 4,854,832 and 6,722,256, include a spool valve having a spool actuator that has "U"-cup seals and receives a sliding "D" valve that establishes fluid interconnections upon shifting of the spool valve. As shown in the aforementioned patents, preferably, the spool actuators are differential actuators having at least two diameters to respond to a differential pressure in order to prevent stalling of the valve.

The seals used on such spool actuators such as the "O"-ring and "U"-cup seals described above, however, require excellent inner surface finishes on the valve body bores. To prolong seal life, a lubricant is also generally used either in the bore or in the seal itself to help reduce friction in moving the piston. However, many pumping applications require a lubrication-free environment to avoid contamination of the media being handled.

The foregoing illustrates limitations known to exist in present valving devices. Thus it is apparent that it would be advantageous to provide an alternative directed to overcoming one or more of the limitations set forth above. Accordingly an alternative valving apparatus is provided including the features more fully disclosed hereinafter.

SUMMARY OF THE INVENTION

According to the present invention, a valve apparatus and pneumatically driven diaphragm pump incorporating same are provided having a valve body having a longitudinal axis and an actuator having an axis with a first end and a second end. The first and second ends have first and second diaphragms, respectively, disposed thereon and located transversely to the axis of the actuator. Upon inserting the actuator into the valve body, the first and second diaphragms define wall portions of first and second chambers at the first and second ends of the axis of the actuator, respectively, and a chamber defined between the diaphragms.

The foregoing and other aspects will become apparent from the following detailed description of the invention when considered in conjunction with accompanying drawing figures.

BRIEF DESCRIPTION OF THE DRAWING FIGURES

DETAILED DESCRIPTION OF THE PREFERRED EMBODIMENTS

Figure 1:
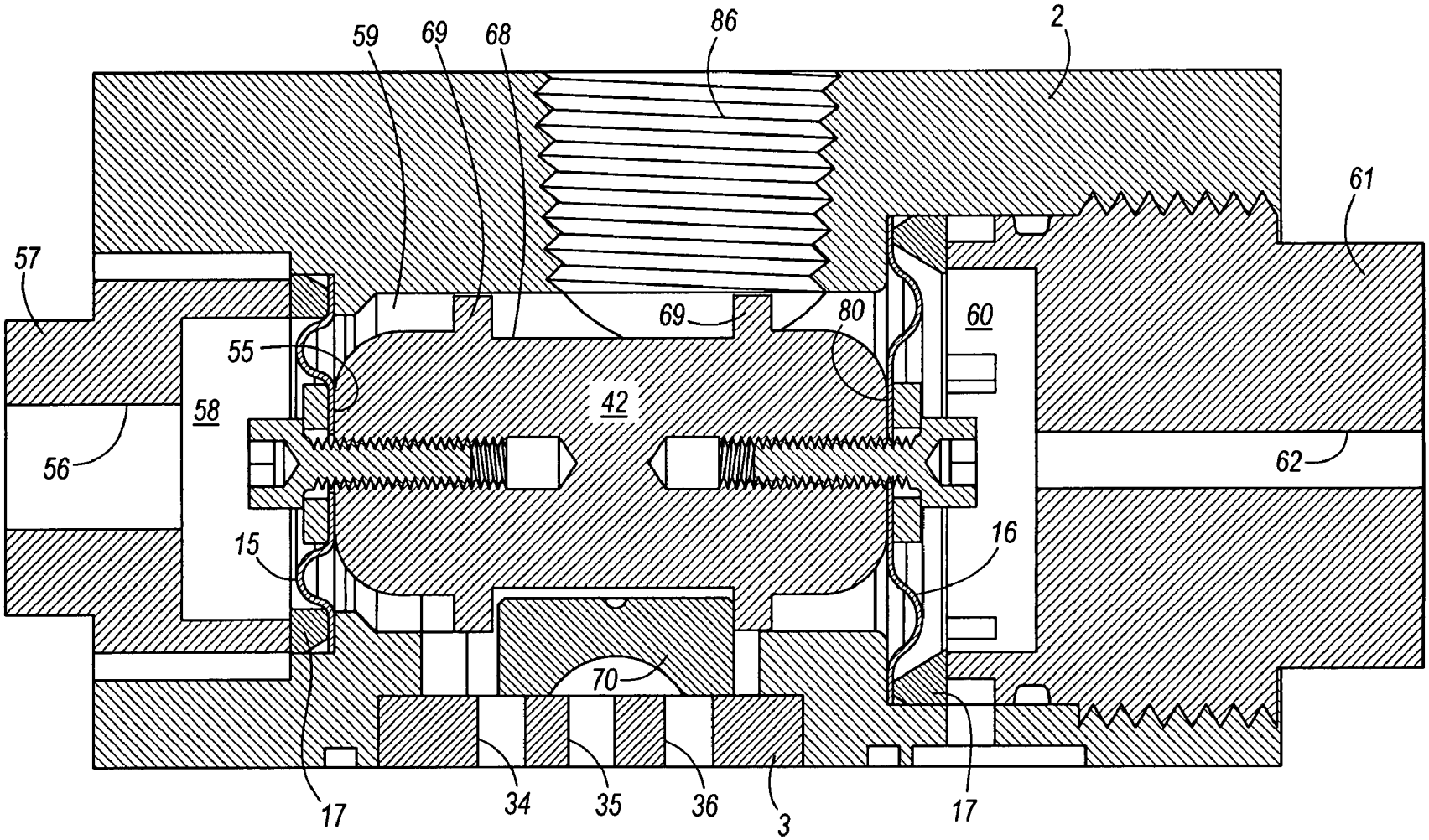
FIG. 1 is a sectional view of a valve apparatus according to the present invention.
Figure 2:
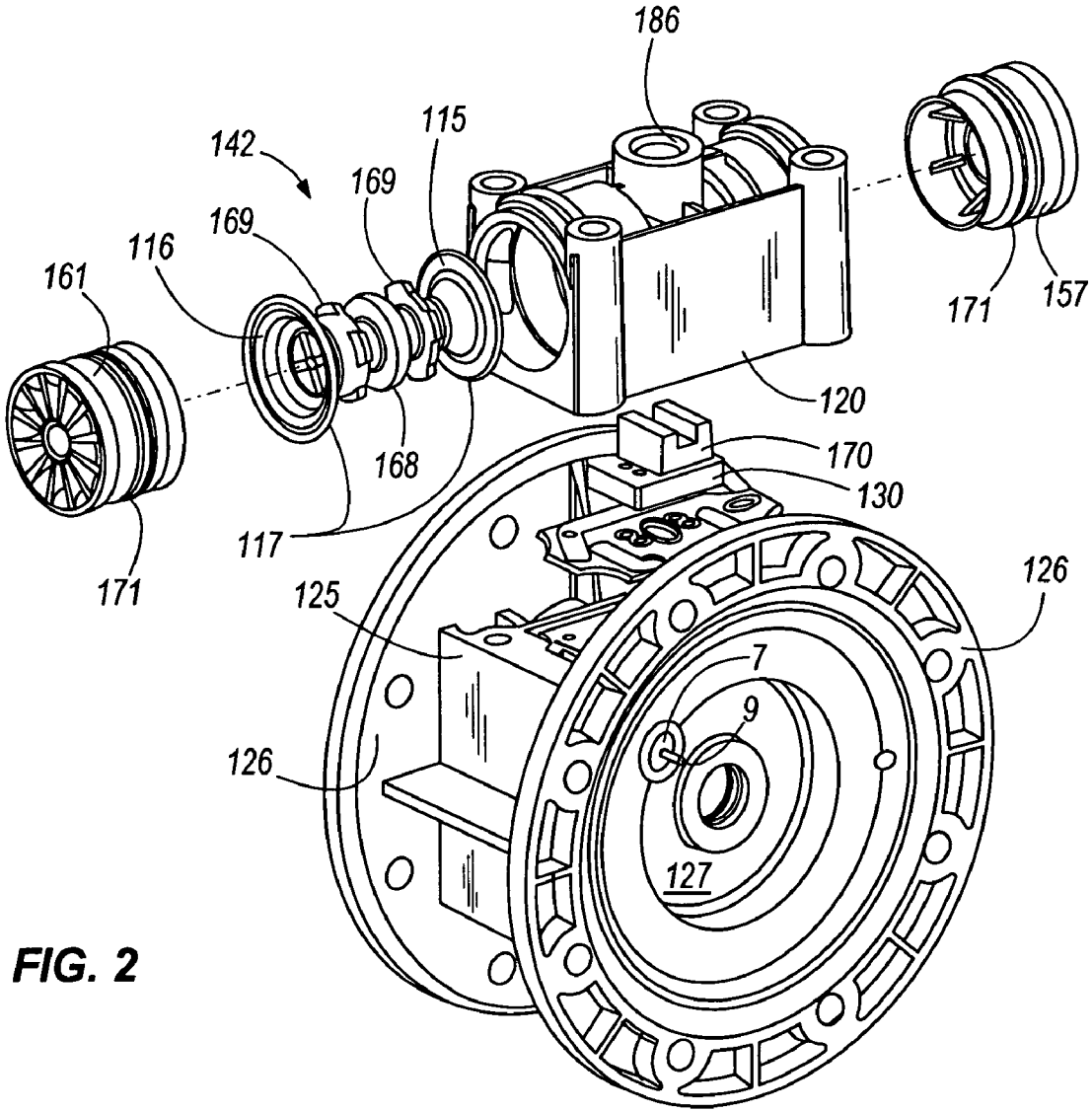
FIG. 2 is partial perspective and partial exploded view of a center body section of a conventional double diaphragm pump attached to a valve apparatus according to the present invention.

As used herein, the term "diaphragm" means a flexible barrier that divides two fluid containing chambers or compartments.

The invention is best understood by reference to the accompanying drawings in which like reference numbers refer to like parts. It is emphasized that, according to common practice, the various dimensions of the diaphragms and the associated pump parts as shown in the drawings are not to scale and have been enlarged for clarity.

Referring now to the drawings, shown in FIG. 1 is a valve apparatus according to the present invention comprising an actuator 42 disposed within a chamber 59 located in a valve block or body 2. Actuator 42 is a generally cylindrical spool member having a first end surface 55 and a second end surface 80 positioned within chamber 59 which is connected to a motive fluid such as compressed air via fluid pressure inlet 86. Actuator 42 has a substantially constant diameter with annular rings 69 having outer diameters that are substantially the same as the inner diameter of chamber 59. An annular groove 68 is defined between annular rings 69 which receives a sliding valve insert 70 that extends through the wall of valve body 2 and slides against a valve plate 3 as shown. Preferably, valve plate 3 and valve insert 70 are constructed of materials that are chemically inert and/or are internally lubricated to minimize chemical compatibility problems and reduce frictional loads, respectively, while also permitting the use of motive gas sources that are dirty.

Chamber 59 is disposed between and coaxially aligned with a first chamber 58 and a second chamber 60. A first diaphragm 15 is attached to first end surface 55 of actuator 42 and disposed between first chamber 58 and chamber 59. A second diaphragm 16 is attached to second end surface 80 of actuator 42 and disposed between second chamber 60 and chamber 59. First and second chambers 58, 60 are alternately connected via first and second passages 56, 62 to a pneumatic pilot signal or to atmosphere to effect shifting of actuator 42 as described in detail below and may be accomplished via a separate mechanical or electrical shifting device. Exemplary shifting devices in this regard being conventional pilot valves that can be solenoid or mechanically activated trip rods to control pneumatic shifting logic, which are known in the art and therefore not described in detail.

Preferably, first diaphragm 15 and second diaphragm 16 are mechanically fastened to their respective ends of actuator 42 and clamped between chamber 59 and first and second chambers 58, 60, respectively. Clamping of the diaphragms in place may be accomplished by a first end cap 57 and a second end cap 61 which threadingly engage inner threads of valve body 2 preferably with sealing members 17 that engage the diaphragms as shown. Sealing members may be discrete elements as shown or may be integrally provided with the diaphragm members as described in detail further below. The diaphragms are manufactured from a flexible material, preferably, from an elastomeric material as is known to those skilled in the art.

The motion of valve insert 70 is limited by the wall of valve body 2 to correspond with the range of motion of the travel of the actuator 42 in chamber 59. Valve plate 3 includes an exhaust aperture 35, a first aperture 34, and a second aperture 36 defined through its thickness. The relative spacing and positions between exhaust aperture 35, first aperture 34, and second aperture 36 are configured such that during operation of the device, first aperture 34 and second aperture 36 are alternately connected to exhaust aperture 35. As described above, supply fluid pressure inlet 86 is connected to chamber 59 and provides fluid pressure to first aperture 34 and second aperture 36 when these apertures are not in fluid connection with exhaust aperture 35. In this manner, actuator 42 slides valve insert 70 between a first position in which first aperture 34 is connected to supply air when second aperture 36 is connected to exhaust and a second position in which second aperture 36 is connected to supply air when first aperture 34 is connected to exhaust.

To provide for actuation in response to pressure differential, the diaphragms are preferably of different diameters relative to one another with first diaphragm 15 having a smaller diameter than second diaphragm 16 as shown. Thus, when pilot fluid pressure is applied to chamber 59, the actuator 42 will be biased toward the larger, first diaphragm 16 due to the larger exposed surface area. When pilot fluid pressure is supplied to chamber 60, the actuator 42 will shift toward the smaller, second diaphragm 15. If pilot fluid pressure is discontinued, the supply pressure from supply fluid inlet 86 again returns the spool to be biased toward the larger, first diaphragm 16. It is to be understood that diaphragms of equal diameter may be alternatively incorporated into the valve apparatus according to the present invention to provide a non-differential design.

Although useful in a variety of applications, the valving apparatus described above may be incorporated as the major valve construction that provides and exhausts motive gas, respectively, to and from an air motor such as those used in diaphragm pumps as described in detail below.

Figure 3:
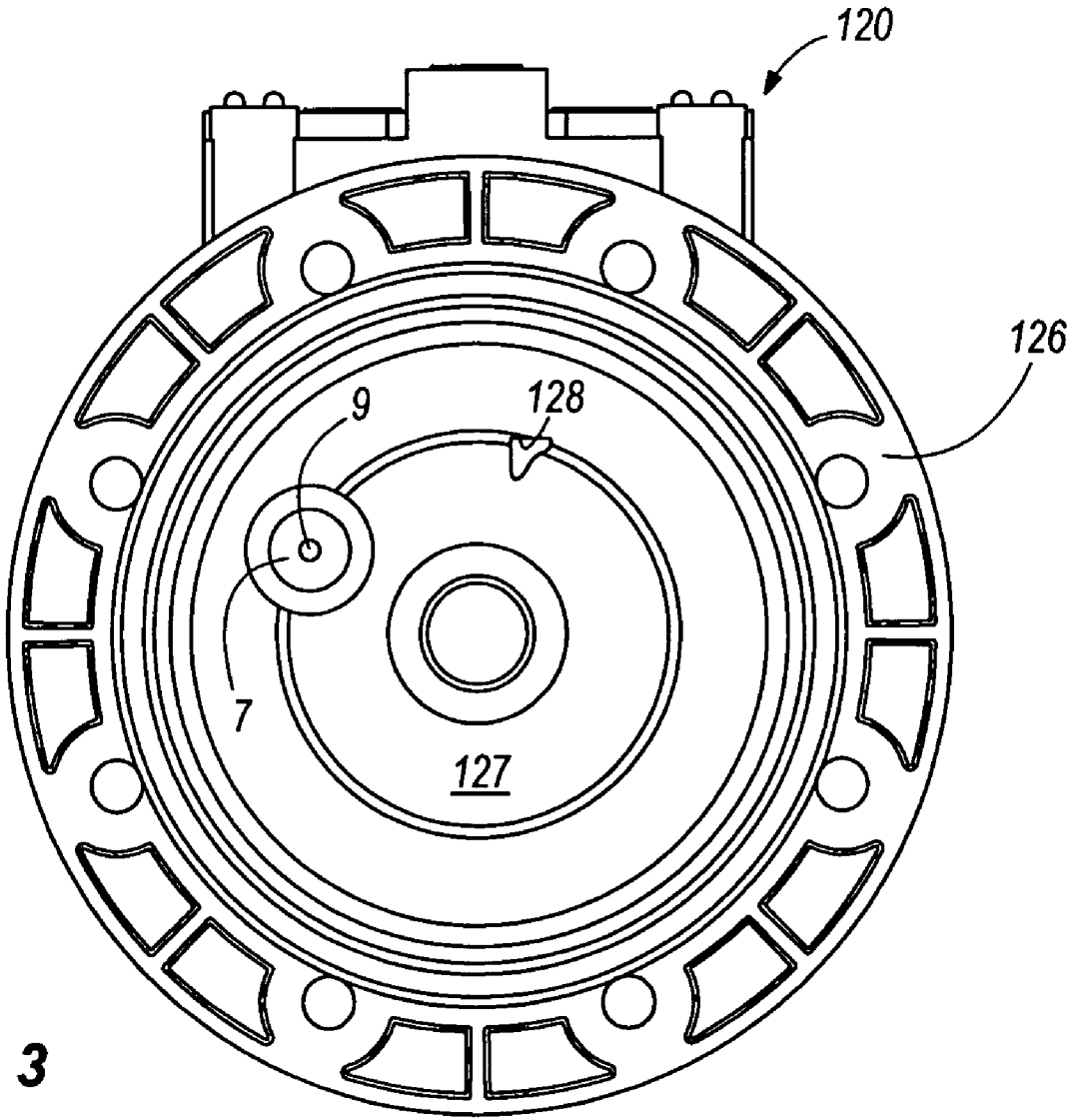
FIG. 3 is a side view of the center body section and assembled valve apparatus shown in FIG. 2.

Shown in FIGS. 2–7 is a center body section 125 of a conventional double diaphragm pump attached to a valve body 120 incorporating the valve construction of the present invention. The center body section 125 is shown in the partial perspective view of FIG. 2 attached to air caps 126 which define first and second opposed axially spaced pressure chambers 127 over which flexible pumping diaphragms (not shown) are mounted as is known in the art. Shown in FIG. 3 is a side view of one of the air caps 126 having a pilot valve comprising a pilot piston 7 and an actuator pin 9 as is known in the art. During operation of the pump, as the pilot piston shifts position with the reciprocation of the diaphragms, pneumatic pilot signals accordingly shift an actuator 142 to shift within valve body 120 at the end of each pump stroke thereby alternating the exhausting and filling of the pressure chambers 127 via ports 128.

Figure 4:
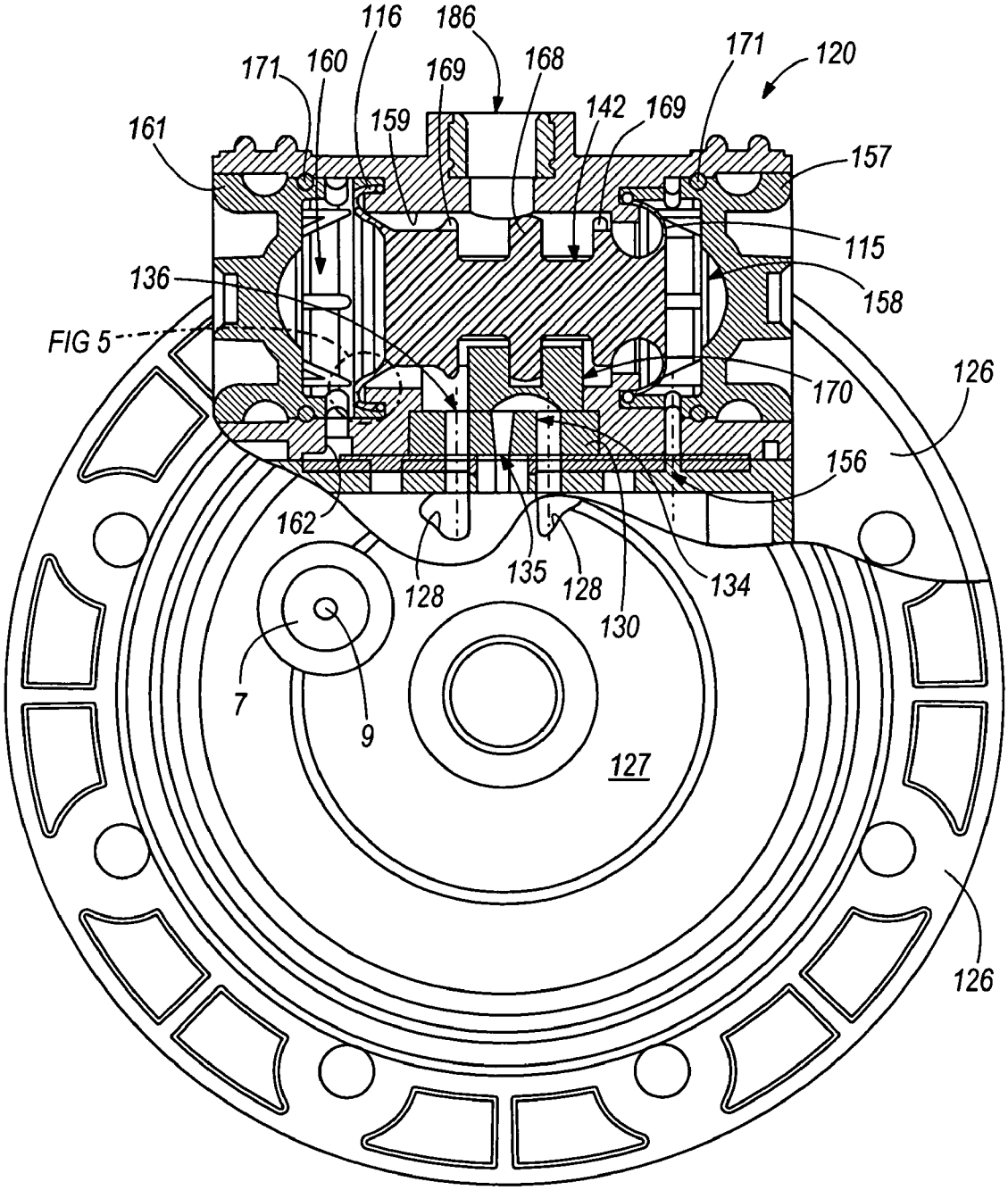
FIG. 4 is a partial sectional view of the double diaphragm pump shown in FIG. 2 showing the sequential operation of the valve apparatus according to the present invention.
Figure 7:
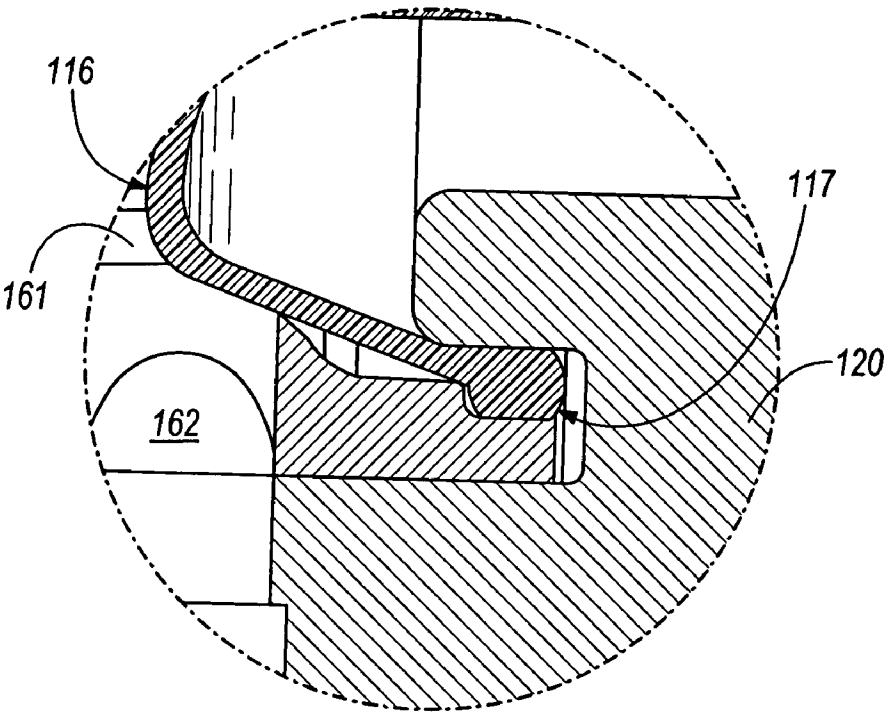
FIG. 7 is an enlarged sectional view showing the region shown bounded by dashed lines in FIG. 6.
Figure 5:
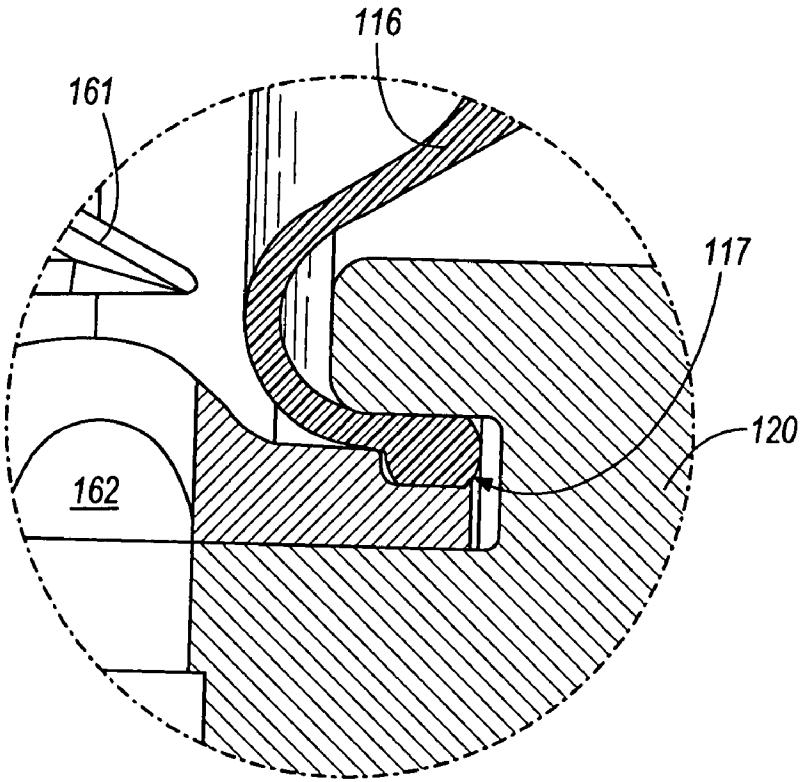
FIG. 5 is an enlarged sectional view showing the region shown bounded by dashed lines in FIG. 4.
Figure 6:
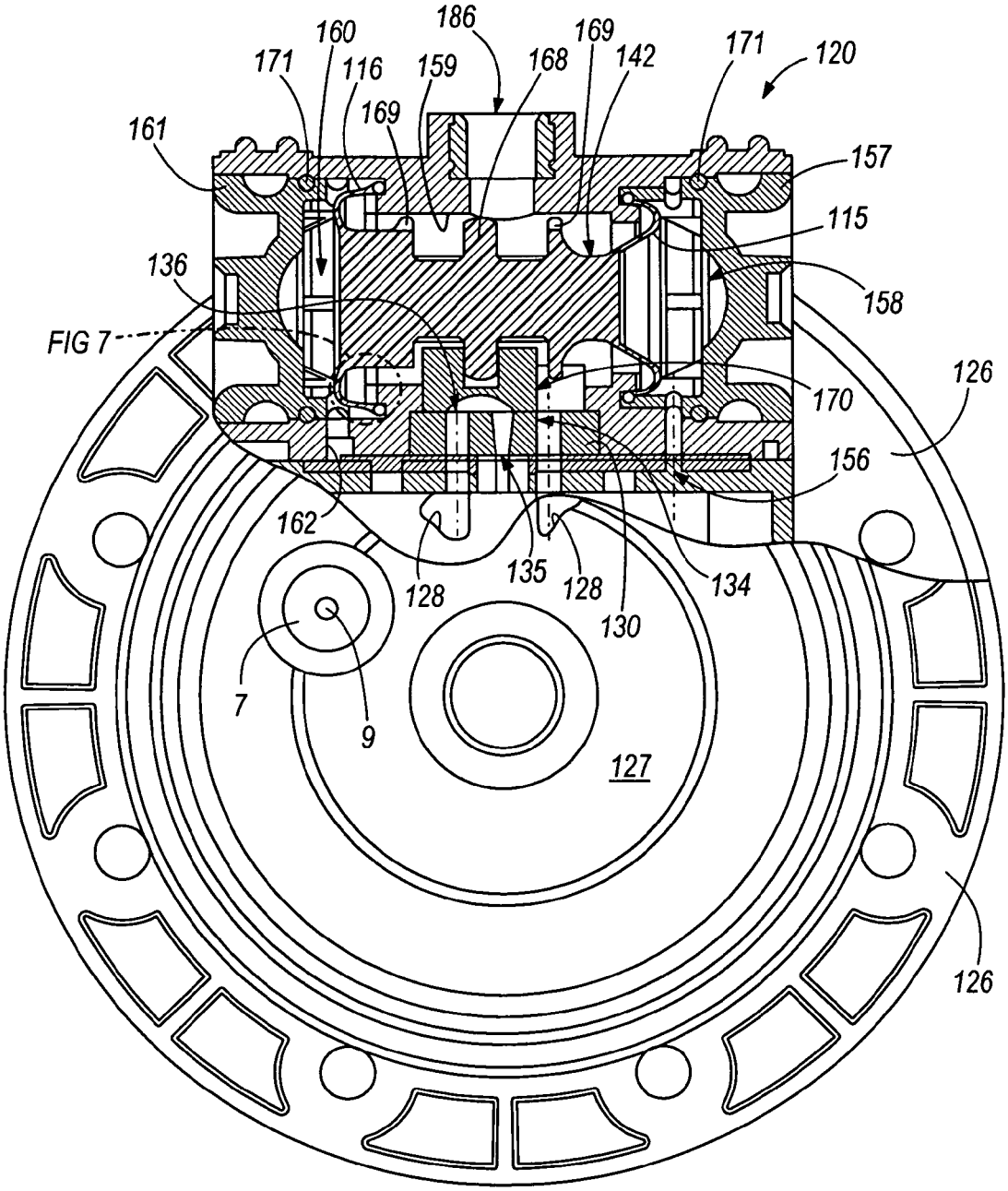
FIG. 6 is a partial sectional view of the double diaphragm pump shown in FIG. 2 showing the sequential operation of the valve apparatus according to the present invention.

Shown in the partial sectional views of FIGS. 4 and 6 is the sequential operation of a valve apparatus according to the present invention as configured for and used in conjunction with a pneumatic double diaphragm pump. The valve apparatus comprises an actuator 142 disposed within a chamber 159 located in a valve block or body 120 and connected to a motive fluid such as compressed air via fluid pressure inlet 186. A first diaphragm 115 and a second diaphragm 116 are integrally attached to actuator 142 and define a first chamber 158 and a second chamber 160, respectively, with the inner surfaces of first and second end caps 157, 161 inserted into valve body 120. O-ring seals 171 are provided as shown between the end caps 157, 161 and the inner surface of valve body 120 to effect sealing therebetween.

First and second chambers 158, 160 are alternately connected via first and second passages 156, 162 to a pneumatic pilot signal or to atmosphere by pilot piston 7 to effect shifting of actuator 142. Chamber 159 is disposed between and coaxially aligned with first chamber 158 and second chamber 160.

Actuator 142 is a generally cylindrical spool member having annular rings with projections 169 on both sides of a valve insert 170. Valve insert 170 slides against a valve plate 130 as shown and, preferably, is also engaged by an annular ring 168 provided on actuator 142. As shown in FIGS. 4–7, first diaphragm 115 and second diaphragm 116 are mechanically clamped between first and second end caps 157, 161 and valve body 120, respectively, by an integral bead portion 117 provided around the periphery of the diaphragms. In this manner, the circumferential bead portions seal chambers 159 from chambers 158 and 160.

The motion of valve insert 170 is limited by the wall of valve body 120 to correspond with the range of motion of the travel of the actuator 142 in chamber 159. Valve plate 130 includes an exhaust aperture 135, a first aperture 134, and a second aperture 136 defined through its thickness. The relative spacing and positions between exhaust aperture 135, first aperture 134, and second aperture 136 are configured such that during operation of the device, first aperture 134 and second aperture 136 are alternately connected to exhaust aperture 135. When connected to exhaust aperture 135, first aperture 134 and second aperture 136 permit pressure chambers 127 to be exhausted via their respective ports 128. As described above, supply fluid pressure inlet 186 is connected to chamber 159 and provides fluid pressure to first aperture 134 and second aperture 136 when these apertures are not in fluid connection with exhaust aperture 135, thereby filling pressure chambers 127 via their respective ports 128. In this manner, actuator 142 slides valve insert 170 between a first position in which first aperture 134 is connected to supply air when second aperture 136 is connected to exhaust and a second position in which second aperture 136 is connected to supply air when first aperture 134 is connected to exhaust.

To provide for actuation in response to pressure differential, the diaphragms are preferably of different diameters relative to one another with first diaphragm 115 having a smaller diameter than second diaphragm 116 as shown. Thus, when pilot fluid pressure is applied to chamber 159, the actuator 142 will be biased toward the larger, second diaphragm 116 due to the larger exposed surface area. When pilot fluid pressure is supplied to chamber 160, the actuator 142 will shift toward the smaller, first diaphragm 115. If pilot fluid pressure is discontinued, the supply pressure from supply fluid inlet 186 again returns the spool to be biased toward the larger, second diaphragm 116. It is to be understood that diaphragms of equal diameter may be alternatively incorporated into the valve apparatus according to the present invention to provide a non-differential design.

With respect to materials selections, actuator 142 may be manufactured from a flexible material, preferably, from a thermoplastic elastomer (TPE) or a thermoplastic urethane (TPU) material that is injection molded. As shown by the partial perspective and partial exploded view of FIG. 2 and the sectional views of FIGS. 4 and 6, "core-outs" may be located longitudinally along the length of these components to facilitate injection molding of these parts. An exemplary material that can be used to injection mold actuator 142 is a 4300 Series polyurethane material available from Parker Hannifin Corporation, Engineered Polymer Systems Division, Salt Lake City, Utah. Although shown integrally provided on actuator 142, diaphragms 115, 116 may alternatively be provided as discrete components attached thereto to facilitate manufacture and/or use of different materials. It is also contemplated that co-molding may be used to integrally provide diaphragms on the actuator using different materials. The selection of different diaphragm materials may be for various reasons including, for example, variation of the flexure properties of the diaphragms.

End caps 157, 161 and valve body 120 can be similarly be injected molded preferably using a thermoset plastic material or otherwise fabricated using a composite or metal material. As shown by the perspective exploded view on FIG. 2 and the sectional views of FIGS. 4 and 6, "core-outs" may be located longitudinally along the length of these components to facilitate injection molding of these parts.

Preferably, valve plate 130 and valve insert 170 are constructed of materials that are chemically inert and/or are internally lubricated to minimize chemical compatibility problems and reduce frictional loads, respectively, while also permitting the use of motive gas sources that are dirty.

While embodiments and applications of this invention have been shown and described, it will be apparent to those skilled in the art that many more modifications are possible without departing from the inventive concepts herein described. For example, although described above with respect to use with pneumatically operated double diaphragm pumps, it is contemplated that the valve apparatus according to the present invention may be incorporated into other pneumatic or hydraulic devices. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A double diaphragm pump adapted to pump a fluid, the double diaphragm comprising:

first and second housing chambers;

a first pump diaphragm disposed within said first housing chamber and sealingly dividing the first housing chamber into a first pressure chamber and a first fluid chamber;

a second pump diaphragm disposed within said second housing chamber and sealingly dividing the second housing chamber into a second pressure chamber and a second fluid chamber;

a valve body defining a valve chamber, the valve chamber communicating with a supply of motive gas;

an actuator within the valve chamber and including first and second ends;

first and second flexible and impervious valve diaphragms mounted to the respective first and second ends of the actuator, a perimeter of each valve diaphragm being attached to the valve body to prevent movement of the perimeter of the valve diaphragms with respect to the valve body, but to permit an inner portion of each valve diaphragm to oscillate within the valve chamber;

wherein the first and second valve diaphragms divide the valve chamber into first and second portions on the sides of the respective first and second diaphragms facing away from each other, and a third portion between the first and second diaphragms, such that there is no fluid flow communication between the third portion and either of the first and second portions through the valve diaphragms, the third portion being in fluid flow communication with a supply of motive gas;

means communicating with at least one of the first and second portions of the valve chamber for shifting the actuator; and means responsive to shifting of the actuator for alternatingly placing one of the first and second pressure chambers in communication with the motive gas in the third portion of the valve chamber while simultaneously placing the other of the first and second pressure chambers in communication with the atmosphere;

wherein shifting of the actuator is accommodated by oscillation of the first and second valve diaphragms.

2. The double diaphragm pump of claim 1, wherein the means for shifting includes a compressed air pilot signal.

3. The double diaphragm pump of claim 1, wherein the first valve diaphragm has a first diameter and the second valve diaphragm has a second diameter, the first diameter being smaller than the second diameter.

4. The double diaphragm pump of claim 1, wherein the first and second valve diaphragms are integral with the first and second ends of the actuator.

5. The double diaphragm pump of claim 1, wherein the actuator includes an annular groove.

6. The double diaphragm pump of claim 5, wherein the means for alternatingly placing includes a valve insert disposed in the annular groove.

7. The double diaphragm pump of claim 1, wherein the means for alternatingly placing further includes a valve plate defining first and second apertures and an exhaust aperture; wherein the first and second pressure chambers communicate with the third portion of the valve chamber through the respective first and second apertures; and wherein the valve insert alternatingly places one of the first and second apertures in communication with the exhaust aperture and the other of the first and second apertures in communication with the third chamber in response to shifting of the actuator; and wherein the valve plate and valve insert are constructed of chemically inert and internally lubricated materials.

* * * * *